US005966344A

United States Patent [19]

Umemoto et al.

[11] Patent Number: 5,966,344

[45] Date of Patent: Oct. 12, 1999

[54] WATCH CONTAINING LIGHT TRANSMITTING METALLIC DIAL

[75] Inventors: Toshio Umemoto; Masami Fukuda; Kenji Shimoda; Yasuo Kitajima; Isamu Kobayashi; Yoshio Katsuki; Yurie Udoh, all of Tanashi, Japan

[73] Assignee: Citizen Watch Co., Ltd., Tokyo, Japan

[21] Appl. No.: 08/917,519

[22] Filed: Aug. 26, 1997

Related U.S. Application Data

[63] Continuation-in-part of application No. 08/549,702, Nov. 15, 1995, filed as application No. PCT/JP95/00188, Feb. 10, 1995, Pat. No. 5,703,837.

[30] Foreign Application Priority Data

| | | | |
|---|---|---|---|
| Mar. 31, 1994 | [JP] | Japan | 6-63450 |
| Apr. 8, 1994 | [JP] | Japan | 6-70299 |
| May 23, 1994 | [JP] | Japan | 6-108372 |

[51] Int. Cl.[6] ..... G04B 19/30; G04B 19/06

[52] U.S. Cl. ..... 368/88; 368/227; 368/232

[58] Field of Search ..... 368/67, 88, 205, 368/223, 226–228, 233, 234, 235; 362/23, 26, 27, 29, 34, 62, 84

[56] References Cited

U.S. PATENT DOCUMENTS

| | | | |
|---|---|---|---|
| 4,775,964 | 10/1988 | Alessio et al. | 368/67 |
| 5,265,071 | 11/1993 | Thorgersen et al. | 368/67 |
| 5,426,621 | 6/1995 | Akasaka | 368/226 |

*Primary Examiner*—Vit W. Miska
*Attorney, Agent, or Firm*—Kanesaka & Takeuchi

[57] ABSTRACT

A light transmitting metallic dial 50 is disposed above a cell 2 such as an EL device, a solar battery, or the like and the light transmitting type metallic dial 50 is secured by engaging an aligning portion 50*b* formed on the light transmitting type metallic dial 50 with an aligning portion 4*b* formed on a casing frame 4. In the light transmitting type metallic dial 50, light transmitting holes 50*a* and 51 constituting various characters, numerals, patterns, and the like are formed. Further, when the transparent plate is laminated on the light transmitting metallic dial 50, a clearance 7 is formed between the cell 2 and the transparent plate 5 using a spacer or the like.

18 Claims, 18 Drawing Sheets

Fig. 11
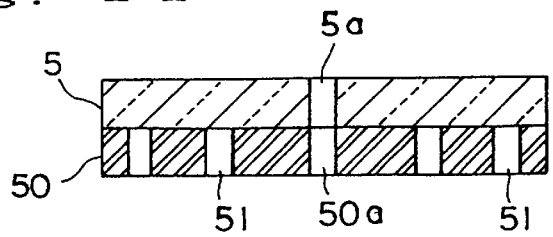
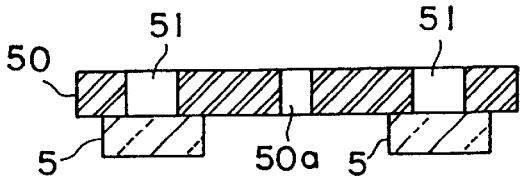
Fig. 12(a)
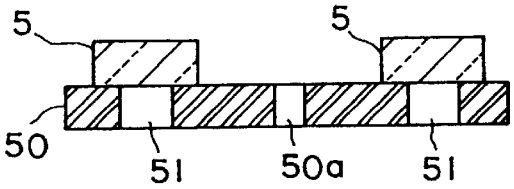
Fig. 12(b)
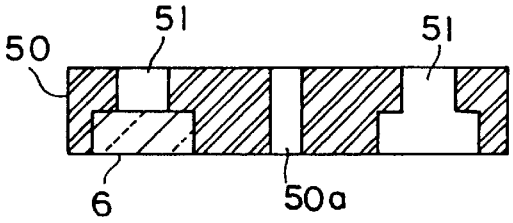
Fig. 13(a)
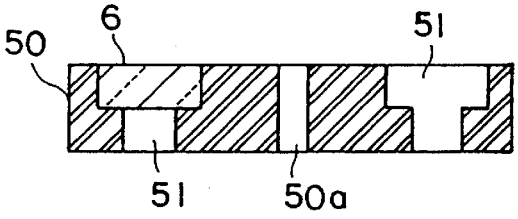
Fig. 13(b)

(a) (b)

(a) (b)

(a) (b)

WATCH CONTAINING LIGHT TRANSMITTING METALLIC DIAL

This application is a continuation-in-part of U.S. application Ser. No. 08/549,702 filed on Nov. 15, 1995, now U.S. Pat. No. 5,703, 837, which is a U.S. National Phase Application of PCT international application No. PCT/JP95/00188 filed on Feb. 10, 1995.

BACKGROUND OF THE INVENTION

1. Field of the Invention

This invention relates to a watch including a display provided with an EL (electroluminescence) device, a solar battery, or the like and a light transmitting metallic dial.

2. Description of the Background Art

If a lamp, light emitting diode, EL device, and the like are built in and these are allowed to emit light for illuminating a symbol and hands for indicating time, the time can be determined even in a dark place. Hence, watches using an EL device, a light emitting diode, or the like in a display have lately been developed.

Conventionally, such a watch using an EL device is proposed in U.S. Pat. No. 4,775,964; Japanese Patent Application Laid-open Nos. 291192/1992 and 248088/1991, and the like.

Among these, displays of watches using an EL device proposed in U.S. Pat. No. 4,775,964 and Japanese Patent Application Laid-open No. 291192/1992 are now explained.

FIG. 27 is a sectional view of a display described in U.S. Pat. No. 4,775,964.

In the display of a watch using an EL device shown in this figure, a symbol 121 called "time characters" indicating time and the like is directly formed by printing or the like on the surface of an EL device 130 mounted on a movement 110 of the watch.

However, in such a display, the symbol 121 is directly formed on the surface of the EL device 130 and hence the appearance as a display is impaired, thereby decreasing the product value.

Also, the color of the display is limited to the color (generally a cream color) of the EL device 130 itself so that there is no coloring freedom.

Japanese Patent Application Laid-open No. 291192/1992 proposes a display which solves such a problem.

FIG. 28 is a sectional view of the display disclosed in Japanese Patent Application Laid-open No. 291192/1992.

The display shown in FIG. 28 comprises a metal layer 131 and a transparent display 120 sequentially laminated on an EL device 130. A symbol 121 indicating time is formed on a transparent plate 120.

Here, the metal layer 131 is formed by coating a metal such as gold, silver, or the like on the EL device 130. The transparent display 120 is directly mounted on the EL device 130 via the metal layer 131.

For the display having such a structure, the appearance and coloring freedom can be improved compared with the display shown in FIG. 27, since the transparent display 120 indicating time and the like is mounted on the EL device 130.

However, in a display such as shown in FIG. 28, the light from the EL device 130 is blocked by the metal layer 131 and hence there is a problem that the display is dark.

Also, the color of the display shown in FIG. 28 is limited to the colors of the EL device 130 and the metal layer 131 when the EL device 130 emits light, and to the color of the metal layer 131 when the EL device 130 does not emit light, whereby the coloring freedom is insufficient.

Further, in such a structure as shown in FIG. 28, because the transparent display 120 and the EL device 130 are intimately combined via the metal layer 131, light interference fringes such as a Newton's ring or the like appear, exhibiting the problem that the appearance, collecting efficiency, and the like are more impaired.

Other than the above, as watches using an EL device and an emitting diode, those having a structure in which a light diffracting plate and a display are secured to the surface of a movement together with an EL device and lamp or emitting diode are proposed. The dial securing structure disclosed in Japanese Utility Model Publication No. 84886/1993 show an example of such a structure.

In the securing structure disclosed in Japanese Utility Model Publication No. 84886/1993, a transparent display and a diffraction plate, which is disposed facing the back face of the transparent display and has almost the same shape as the transparent display, are secured to a casing frame using a double faced adhesive tape.

Such a display fixing structure has the advantage that the light diffraction plate and the transparent display can be simply secured to the casing frame using a double faced adhesive tape. On the contrary, in the display fixing structure, the transparent display cannot be aligned with the casing frame and hence the alignment is entrusted to a working method such as measurement by eye, resulting in unstable alignment.

Also, because the transparent display and the casing frame are attached together using a double faced adhesive tape, separation of the transparent display from the casing frame is difficult so that there is the problem that fabrication repairs and after-sale services are difficult.

On the other hand, reflecting recent environmental problems, new merits of a clean solar battery have been discovered and hence watches using such a solar battery are being developed.

Examples of the securing structure of a watch in which a solar battery is secured to the surface of a movement together with a display include various structures in which a solar battery is exposed, making use of the color of the solar battery itself; time characters and the like are directly printed on the surface of a solar battery; a transparent seal provided with time characters and printing for decoration is attached to a solar battery and this solar battery is secured using a fixed member; and the like.

Other than the above structures, structures have been proposed in which a decorative parting plate is assembled at the periphery of a solar battery and a pin for the parting plate is pressed into a watch movement, while a solar battery is supported with the parting plate, to secure the solar battery; a light transmitting display is incorporated into the surface side of a solar battery when a watch casing is mounted to support the light transmitting display with the watch casing and thereby to secure the solar battery; and the like.

Conventional structures for securing a solar battery and a display are now explained with reference to the drawings.

FIG. 29 is a sectional view schematically showing a watch in which a transparent seal is attached to the surface of a solar battery.

In the solar battery securing structure shown in this FIG. 29, a transparent seal 151 provided with decoration by printing or the like is attached to the surface of a solar battery 140 excepting the portion for a hand shaft 152 and a solar battery securing member 153 is combined with a movement 110, thereby securing, to a movement 110, the solar battery 140, to which the transparent seal 151 is attached.

FIG. 30 is a view showing a watch equipped with a solar battery in which the solar battery is secured using a parting plate. FIGS. 30(*a*) and 30(*b*)are a schematically sectional view and its top plan view respectively.

The watch equipped with a solar battery as shown in FIG. 30 has a structure in which a securing pin 154*a* for a parting plate 154 provided with printing and the like is engaged in a plurality of holes 110*a* provided in a flange portion of a movement 110, thereby incorporating the parting plate 154 into the movement 110 and sandwiching the solar battery 140 between the parting plate 154 and the movement 110 to secure the solar battery 140 to the movement 110.

FIG. 31 is a schematically sectional view showing the case of supporting a solar battery mounting a light transmitting display by a watch casing.

In the solar battery securing structure shown in FIG. 31, a casing 155 is installed on a movement 110 which is completed by incorporating a solar battery and a solar battery securing member 153 for aligning the solar battery 140, and a light transmitting display 160 is incorporated at the same time as the armor 155 is installed to secure the light transmittable display 160 by the casing 155 in the condition where the watch is completed.

However, there are the following various problems in these conventional solar battery securing structures.

First, in the structure shown FIG. 29, since the transparent seal is directly attached to the surface of the solar battery, replacing only the attached transparent seal is difficult when failure of the transparent seal is observed after the manufacture of the watch has been completed. In this case, the expensive solar battery must also be replaced at the same time.

Also, for the watches in which the seal is attached in this way, product variations are limited after the movement is completed and reapplication of the adhesive seal is difficult. Further, there are the problems that the working characteristics are impaired and the productivity is low.

The use of the solar battery securing structure shown in FIG. 29 has led to increased costs for the watch as a whole.

On the other hand, in the securing structure shown in FIG. 30, the surface of a solar battery is exposed. Since the color tone of the solar battery is determined in advance, the product is not too attractive even if the design of the parting plate is altered. Specifically, there is the problem that the design is greatly limited.

Also, the securing structure shown in FIG. 31 has the drawback that the position of the light transmitting display mounted on the solar battery is not determined while the casing is installed after the hands are attached, which is a cause of instability, exhibiting the problems of extremely impaired working and handling characteristics.

Further, because the transparent display 160 is arranged directly on the solar battery 140 in the same manner as in the display shown in FIG. 28 light interference fringes such as a Newton's ring or the like appear in the display using a solar battery shown in FIG. 31, exhibiting the problem that the appearance, collecting efficiency, and the like are impaired.

As is clear from the above explanations, conventional watches using an EL device, solar battery, or the like, have the various drawbacks that the color of the display is limited to that of the EL device or the solar battery whereby there is little coloring freedom and the appearance is impaired, fabrication, dismounting, and the like are not easy, and if a transparent display is arranged to improve the appearance and the like, light interference fringes such as a Newton's ring or the like appear at the boundary between the transparent display and the EL device or the solar battery due to light refraction, whereby the appearance, collecting efficiency, and the like are impaired.

SUMMARY OF THE INVENTION

Accordingly, it is an object of the present invention to provide a watch containing a light transmitting metallic dial, wherein the metallic dial provided with drilled through holes, through which light is transmitted, is disposed above an EL device and a solar battery in a dismounting-free manner, whereby the appearances of characters and the like is improved, the coloring freedom of the display is increased, a clear display can be prepared, the metallic dial is easily replaced, and even if a light transmitting material is used, the occurrences of a Newton's ring and the like can be avoided, thereby increasing the collecting efficiency.

Another object of the present invention is to provide a watch containing a light transmitting metallic dial wherein the light transmitting metallic dial provided with a variety of characters, patterns, and the like, is installed in an exchange-free manner, whereby product variations are increased, the metallic dial can be aligned by only a simple operation, and the attachment and detachment of the metallic dial to a casing frame are facilitated.

The above object can be attained in the present invention by the provision of a watch containing a light transmitting metallic dial formed by laminating a cell comprising an emitting member or an absorbing member such as an EL device, solar battery, or the like on a movement and securing the cell by a support material, wherein the metallic dial is disposed above the cell such as an EL device, a solar battery, or the like, light transmitting through-holes for forming a scale, numerals, and patterns are formed by drilling, and aligning portions composed, for example, of a convex portion and a concave portion are formed in the light transmitting type metallic dial and the support material and these aligning portions are engaged to integrate the light transmitting metallic dial with the cell.

The above object can be also attained in the present invention by the provision of a watch containing a light transmitting metallic dial formed by laminating a cell comprising of an emitting member or an absorbing member such as an EL device or a solar battery, on a movement, wherein a light transmitting metallic dial is disposed above the cell such as an EL device or solar battery, light transmitting through holes for forming a scale, numerals, and patterns are formed by drilling, and aligning portions composed, for example, of a projection and a hole are formed in the light transmitting type metallic dial and the movement and these aligning portions are engaged to secure the light transmitting metallic dial.

Because the metallic dial is selectively disposed, replaced, or the like as required in the above structure, the variations in the display of the watch are increased, securing and fabricating operations are facilitated whereby the workability in the fabrication and repair is remarkably improved.

Also, in the present invention, a light transmitting material such as a transparent plate or the like is optionally laminated on the light transmitting metallic dial.

In the case of disposing a light transmitting material such as a transparent plate on the light transmitting metallic dial, a clearance for preventing light interference fringes such as a Newton's ring or the like is formed.

In the above structure of the present invention, the light transmitting material can be optionally exchanged whereby enjoyable various colors and decorations are provided and the coloring freedom of the display can be increased.

Also, in the case of laminating a transparent plate composed of a light transmitting material on the metallic dial, light interference fringes such as a Newton's ring or the like is efficiently prevented, the collecting efficiency is improved, a clear display can be obtained, and the appearance of the display can be improved.

BRIEF DESCRIPRION OF THE DRAWINGS

Figure 9A:
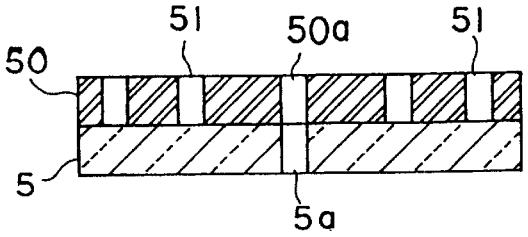
Figure 9B:
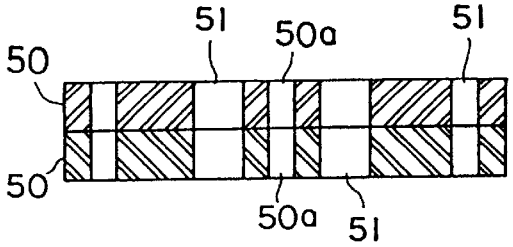
Figure 9C:
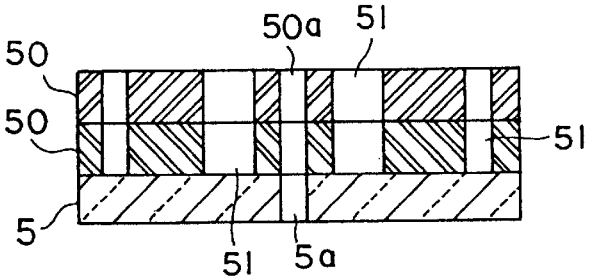

FIGS. 9*a*–9*c* are schematically explanatory views showing the laminating condition of a metallic plate and a transparent plate in the second embodiment of the present invention.

Figure 10A:
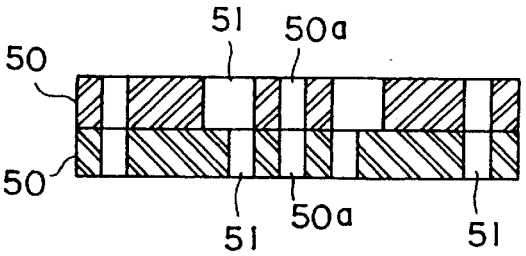
Figure 10B:
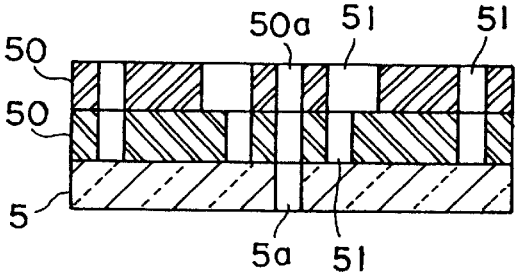

FIGS. 10*a*–10*b* are schematically explanatory views showing the laminating condition of a metallic plate and a transparent plate in the second embodiment of the present invention.

FIGS. 11 is a schematically explanatory view showing the laminating condition of a metallic plate and a transparent plate in the second embodiment of the present invention.

FIGS. 12*a*–12*b* are schematically explanatory views showing the laminating condition of a metallic plate and a transparent plate in the second embodiment of the present invention.

FIGS. 13*a*–13*b* are schematically explanatory view showing the laminating condition of a metallic plate and a transparent plate in a third embodiment of the present invention.

FIGS. 14*a*–14*b* are schematically explanatory view-showing the laminating condition of a metallic plate and a transparent plate in a third embodiment of the present invention.

Figure 15:
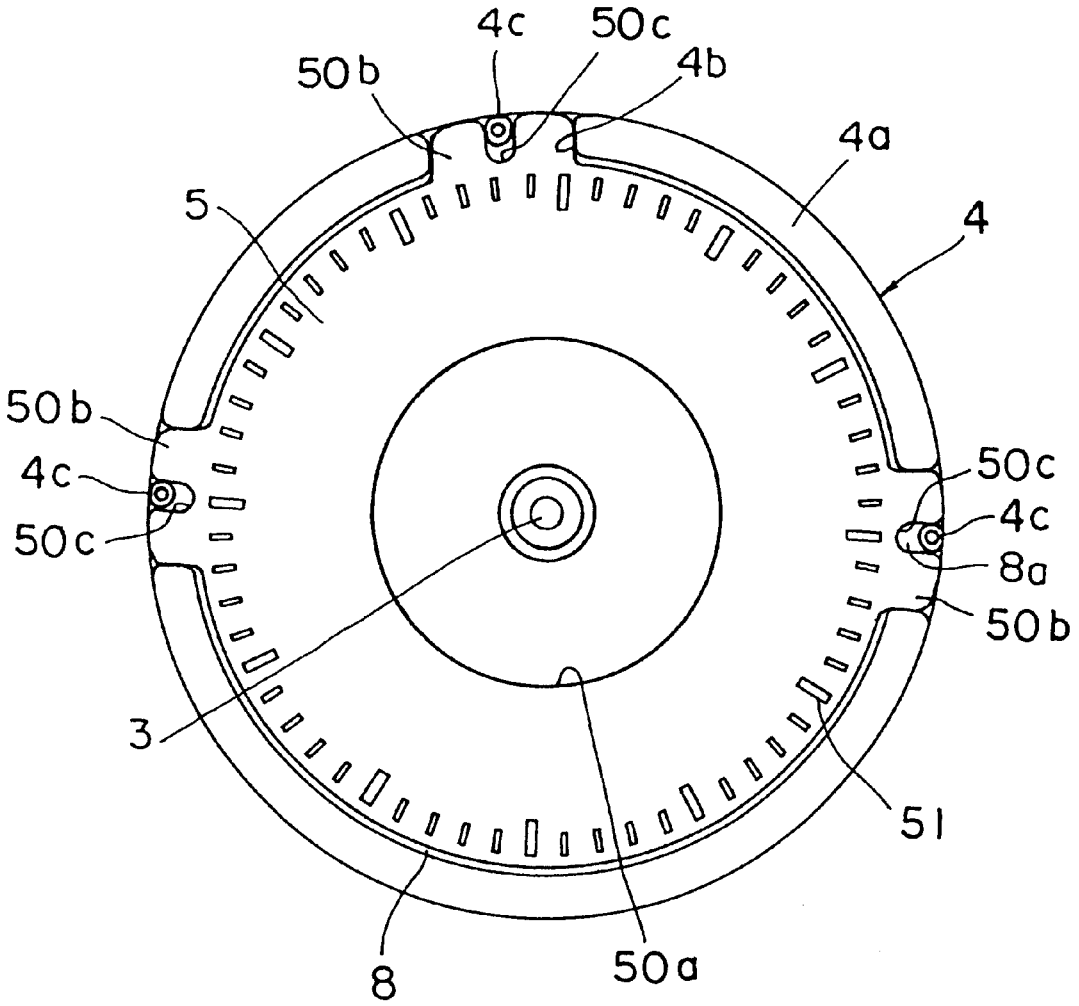

FIG. 15 is a top plan view corresponding to a fourth embodiment of the present invention, in which the casing of a watch is omitted.

Figure 16:
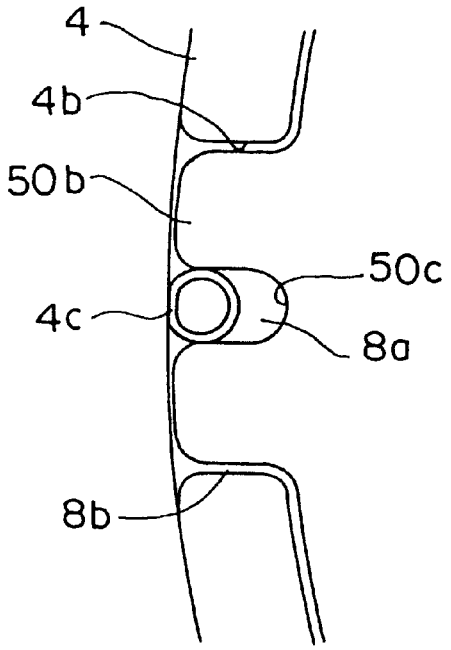

FIG. 16 is an enlarged top plan view showing a major part corresponding to a fourth embodiment of the present invention, in which the casing of a watch is omitted.

Figure 17:
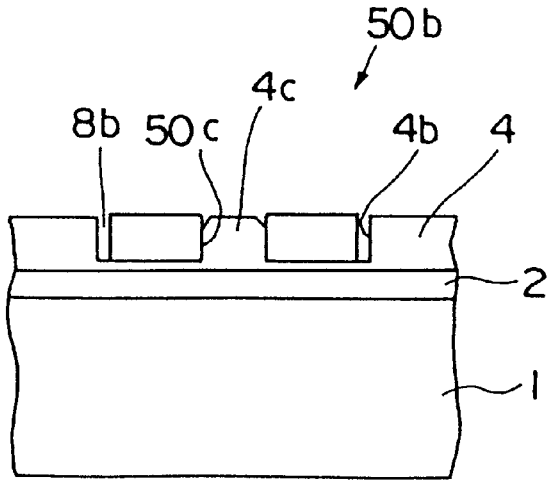

FIG. 17 is an enlarged side view showing a major part corresponding to the fourth embodiment of the present invention, in which the casing of a watch is omitted.

Figure 18:
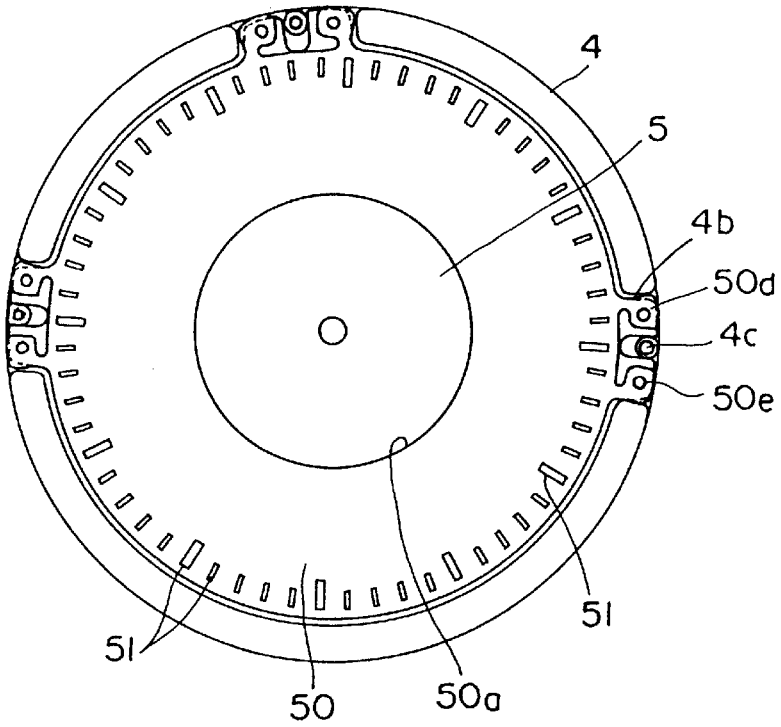

FIG. 18 is a top plan view corresponding to a fifth embodiment of the present invention, in which the casing of a watch is omitted.

Figure 19:
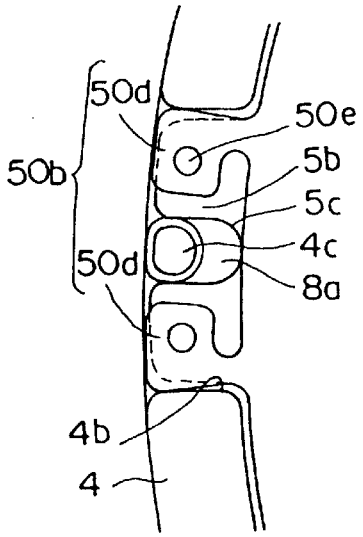

FIG. 19 is an enlarged top plan view showing a major part corresponding to a fifth embodiment of the present invention, in which the casing of a watch is omitted.

Figure 20:
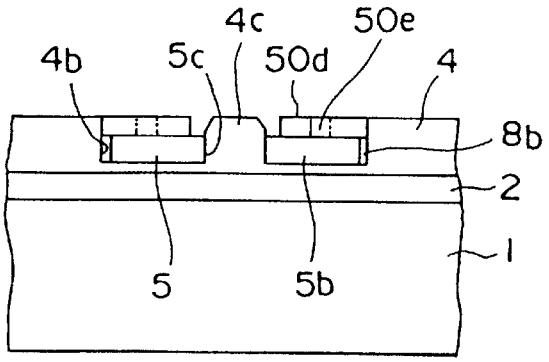

FIG. 20 is an enlarged side view showing a major part corresponding to the fifth embodiment of the present invention, in which the casing of a watch is omitted.

Figure 21:
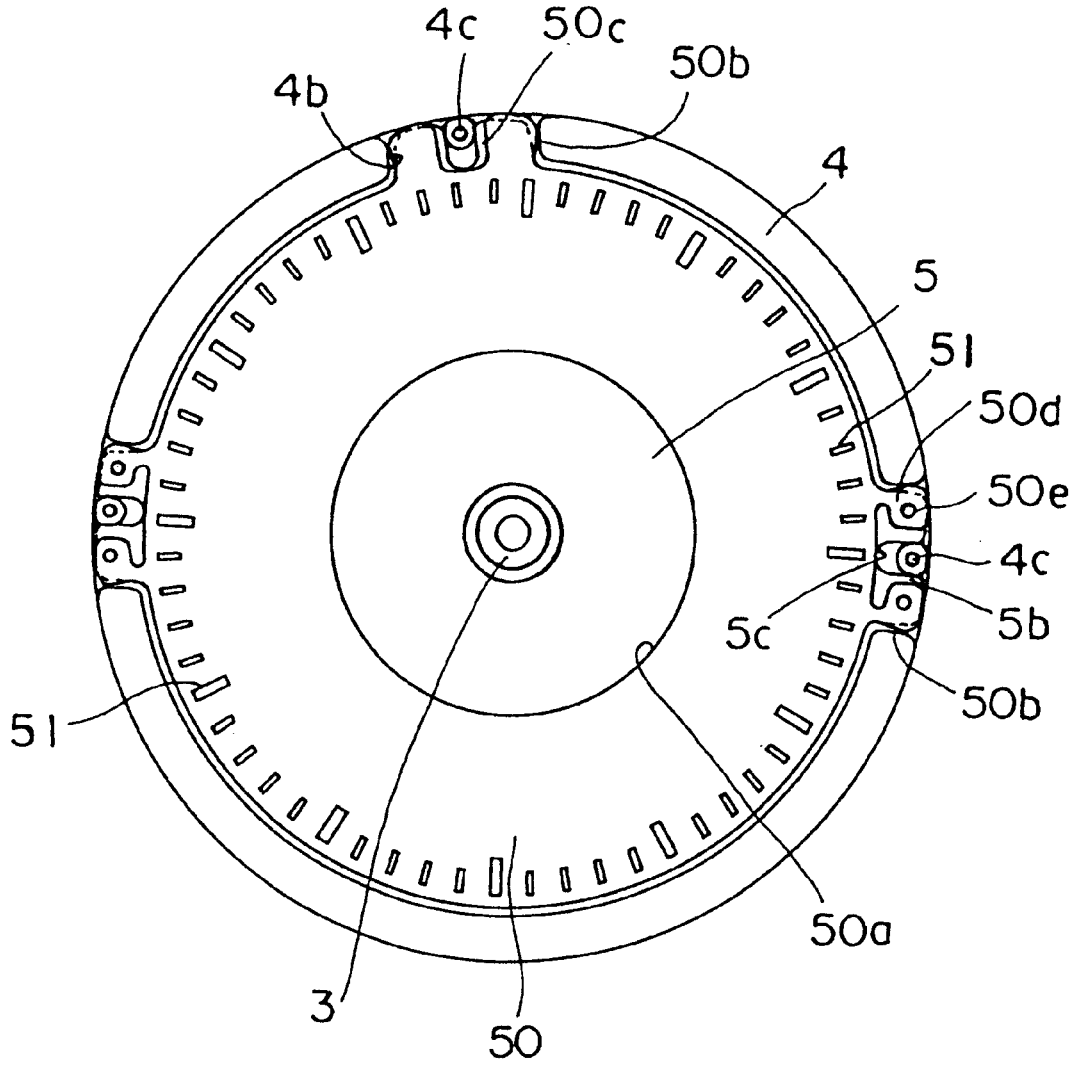

FIG. 21 is a top plan view corresponding to a sixth embodiment of the present invention, in which the casing of a watch is omitted.

Figure 22:
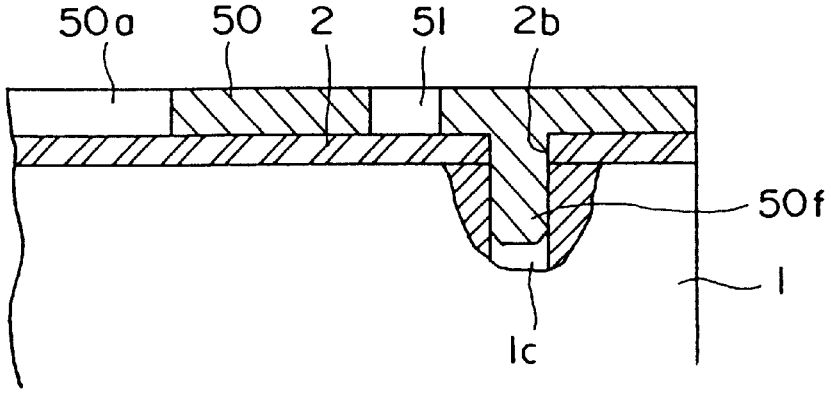

FIG. 22 is a top plan view corresponding to a seventh embodiment of the present invention, in which the casing of a watch is omitted.

Figure 23:
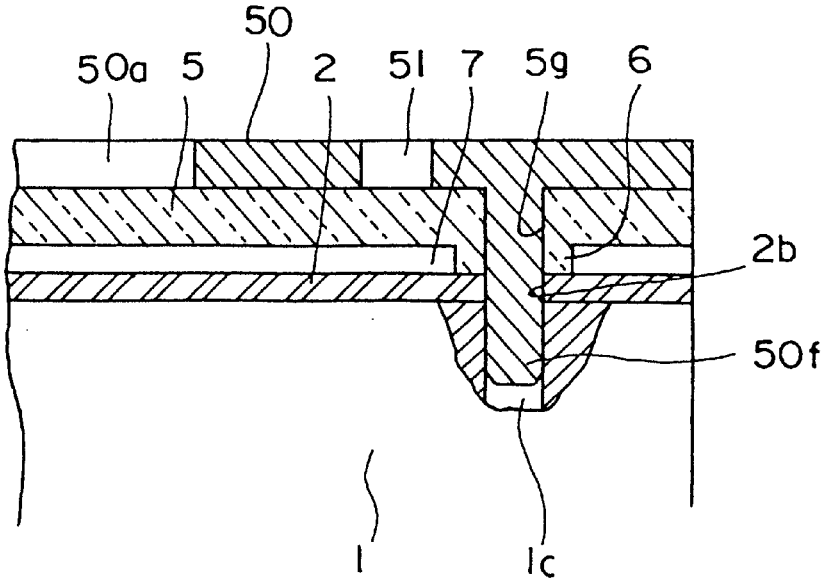

FIG. 23 is a top plan view corresponding to an eighth embodiment of the present invention, in which the casing of a watch is omitted.

Figure 24:
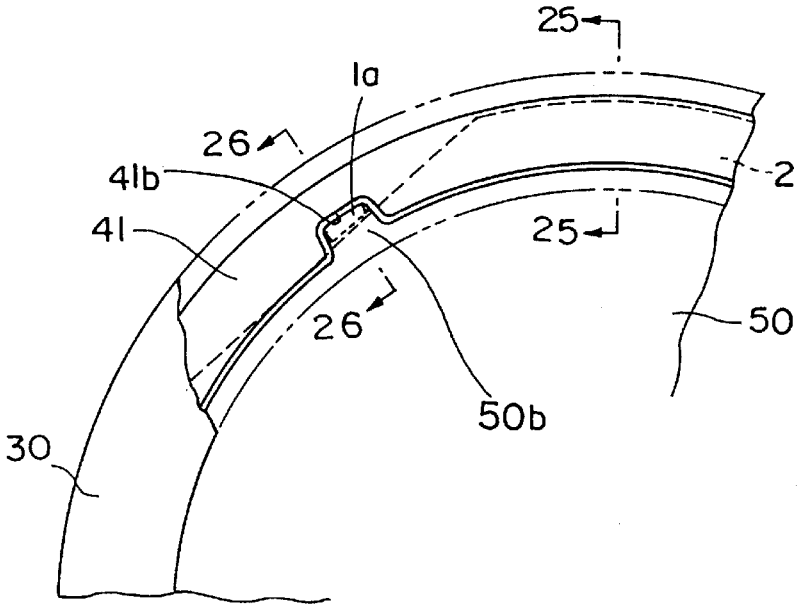

FIG. 24 is a partial top plan view corresponding to a ninth embodiment of the present invention.

Figure 25:
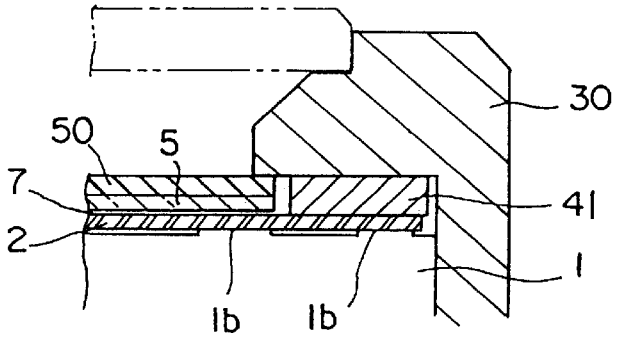

FIG. 25 is a sectional view along the line 25—25 in FIG. 24.

Figure 26:
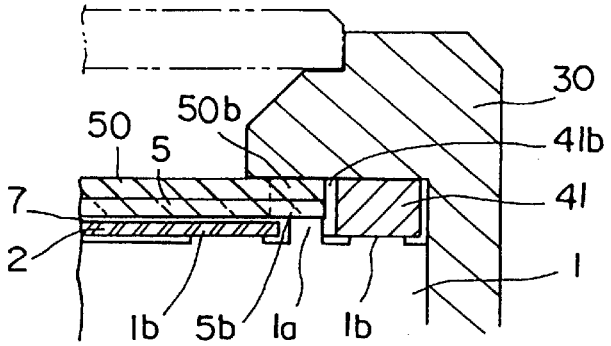

FIG. 26 is a sectional view along the line 26—26 in FIG. 24.

Figure 27:
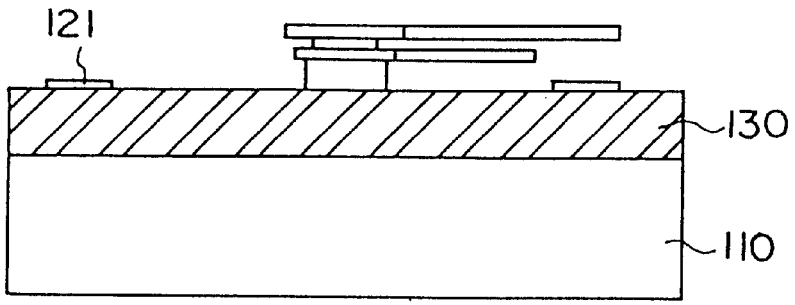

FIG. 27 is a schematically sectional view of a first conventional example, in which the casing of a watch is omitted.

Figure 28:
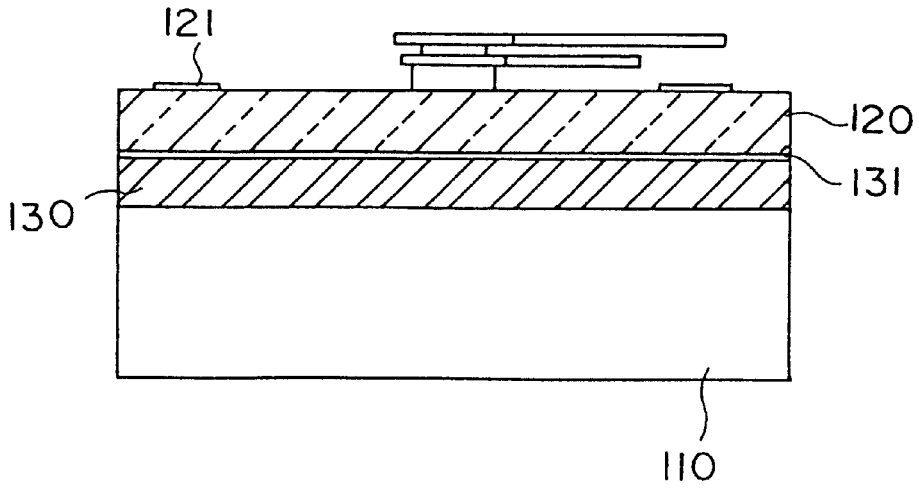

FIG. 28 is a schematically sectional view of a second conventional example, in which the casing of a watch is omitted.

Figure 29:
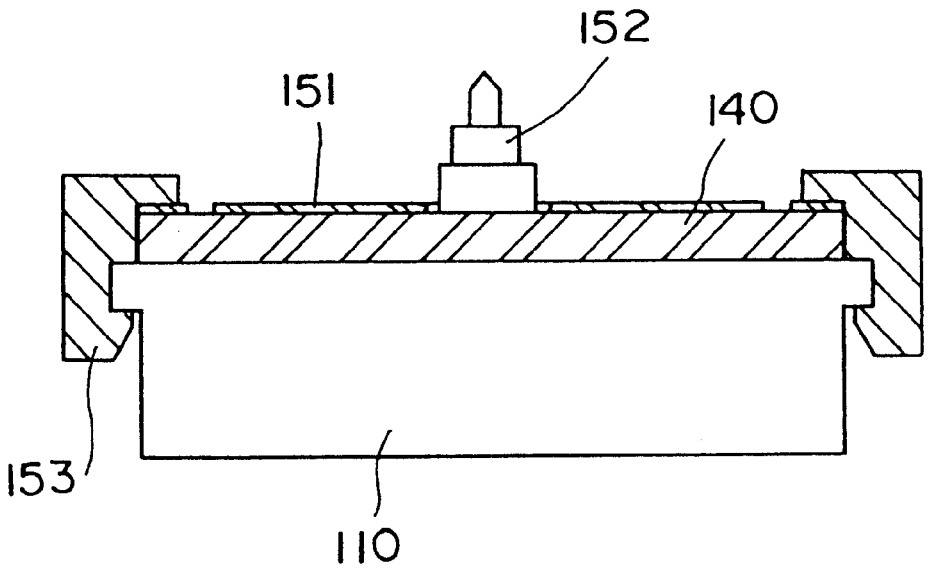

FIG. 29 is a schematically sectional view of a third conventional example, in which the casing of a watch is omitted.

Figure 30A:
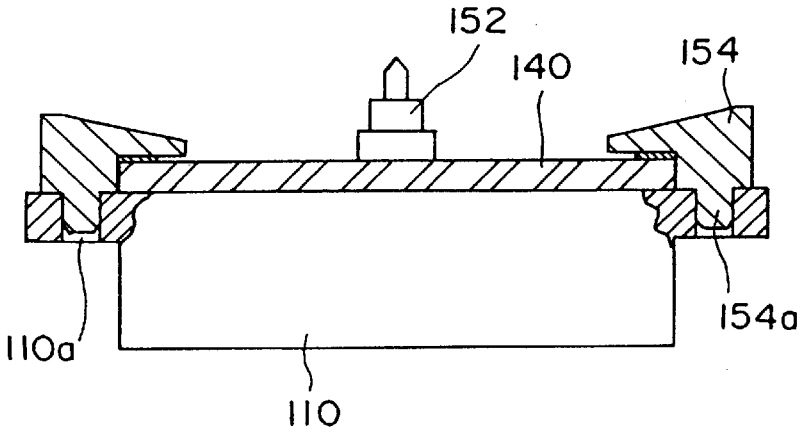
Figure 30B:
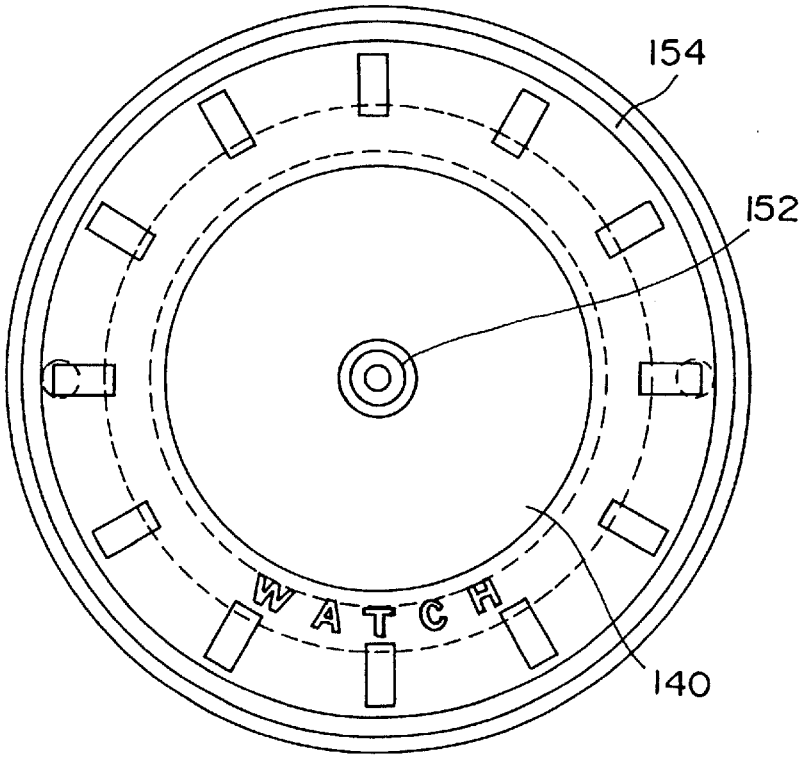

FIG. 30(*a*) is a schematically sectional view of a fourth conventional example and FIG. 30(*b*) is a top plan view of a fourth conventional example.

Figure 31:
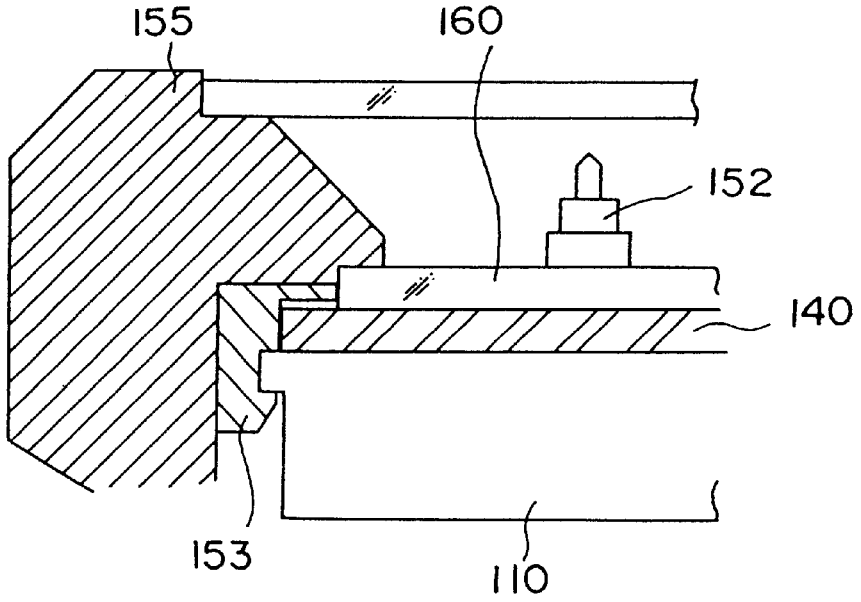

FIG. 31 is a schematically sectional view showing a major part of a fifth conventional example, in which the casing of a watch is omitted.

DETAILED DESCRIPTION OF THE INVENTION AND PREFERRED EMBODIMENTS

A preferred embodiment of a watch containing a light transmitting metallic dial in the present invention will be explained in more detail with reference to the drawings.

First Embodiment

A first embodiment of a watch containing a light transmitting metallic dial in the present invention will be explained with reference to FIGS. 1 and 2.

Figure 1:
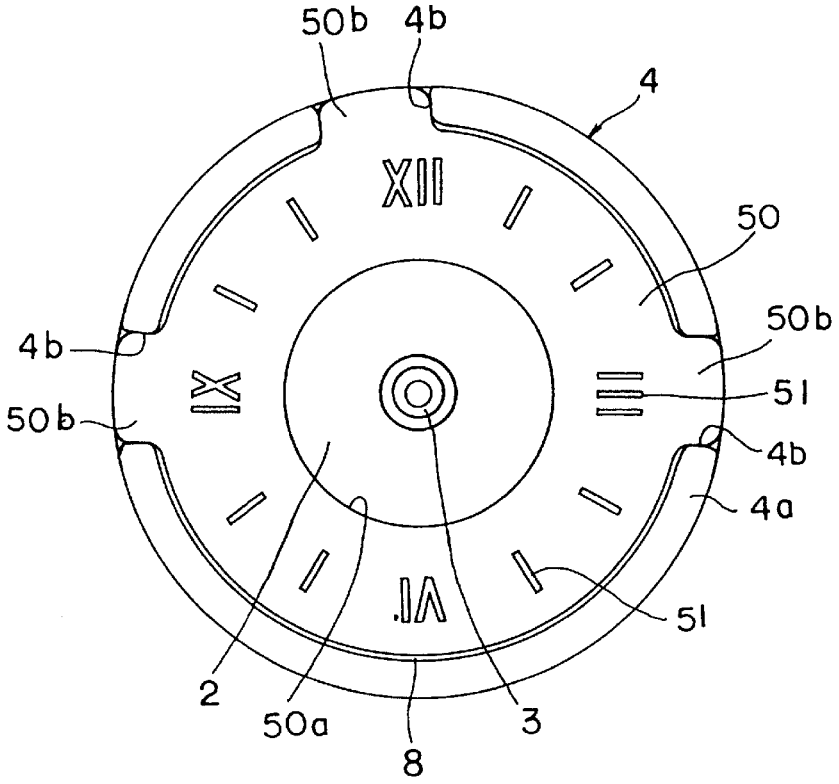
FIG. 1 is a top plan view corresponding to a first embodiment of the present invention, in which the casing of a watch is omitted.
Figure 2:
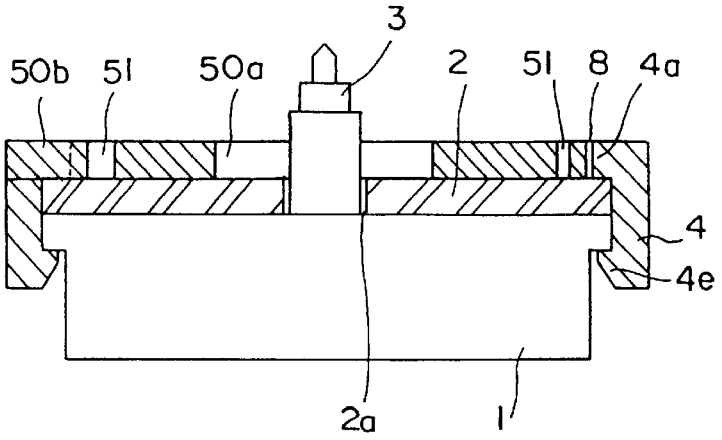
FIG. 2 is a schematically sectional view corresponding to the first embodiment of the present invention, in which the casing of a watch is omitted.

FIGS. 1 and 2 are a top plan view and a schematically sectional view corresponding to a first embodiment of the present invention, in which the casing of a watch is omitted.

In a watch of the first embodiment of the present invention shown in FIGS. 1 and 2, a cell 2 constituting an emitting material such as an EL device or the like or an absorbing material such as a solar battery or the like is mounted on the surface of a movement 1. The cell 2 has the same plane shape as the movement 1. A hole 2*a* through which a hand shaft 3 is inserted is provided in the center of the cell 2.

A casing frame 4 is a resin forming material with a ring shape and the upper portion thereof is provided with a flange 4*a* projecting inward. As shown in FIG. 2, a hook portion 4*e*, which is engaged with a convex portion of the side of the movement 1, is formed at the lower end of the casing frame 4.

When the casing frame 4 is placed on the outside of the movement 1, the outer periphery of the cell 2 is clipped between the back face of the flange 4*a* and the surface of the movement 1, whereby the cell 2 is secured to the surface of the movement 1.

Also, concave portions 4*b* with a channel shape extending from the inside to the outside are formed as aligning portions on the surface of the flange portion 4*a* of the casing frame 4. The concave portions 4*b* are formed at three positions on the flange portion 4*a*. Among these portions 4*b*, two concave portions 4*b* are formed at opposite locations at an angle of 180 degree. The remaining concave portion 4*b* is formed at the position slightly shifted from the center between the above two concave portions 4*b*.

A metallic dial 50 is disposed above the cell 2 secured by the casing frame 4 in this manner.

A plurality of through holes 50*a*, 51 which transmit light is formed by drilling in the metallic dial 50 and the through hole 51 constitutes a scale and numerals of a watch as shown in FIG. 1.

More specifically, in the center of the light transmitting metallic dial (hereinafter called "metallic plate") 50, a hole 50*a* for inserting a hand shaft 3 is formed. Also, convex portions 50*b* projecting externally from the periphery of the metallic dial 50 are formed as aligning portions at three positions of the periphery corresponding to the concave portions 4*b* formed at flange portion 4*a* of the casing frame 4.

Around the hole 50*a* of the metallic plate 50, numerals and a scale which indicate time are formed along the circumference by the through-hole 51.

The metallic plate 50 is a thin metallic plate composed of any material .selected from a group consisting of brass, copper, nickel silver, stainless steel, titanium, titanium alloy, aluminum, aluminum alloy, nickel, and the like. The metallic plate is provided with indications and decorations such as a scales commercial name, numerals, patterns, and the like by forming through-holes by drilling or using other means such as printing or the like.

In this embodiment, a'metallic plate which is surface-treated by plating or painting is used as the metallic plate 50, part or all of the decorations such as a scale, numerals, patterns, and the like are formed by the hole 50*a* and the through-hole 51 for inserting the hand shaft, and the hole 50*a* and the through-hole 51 serve to transmit light to cell 2.

Figure 3:
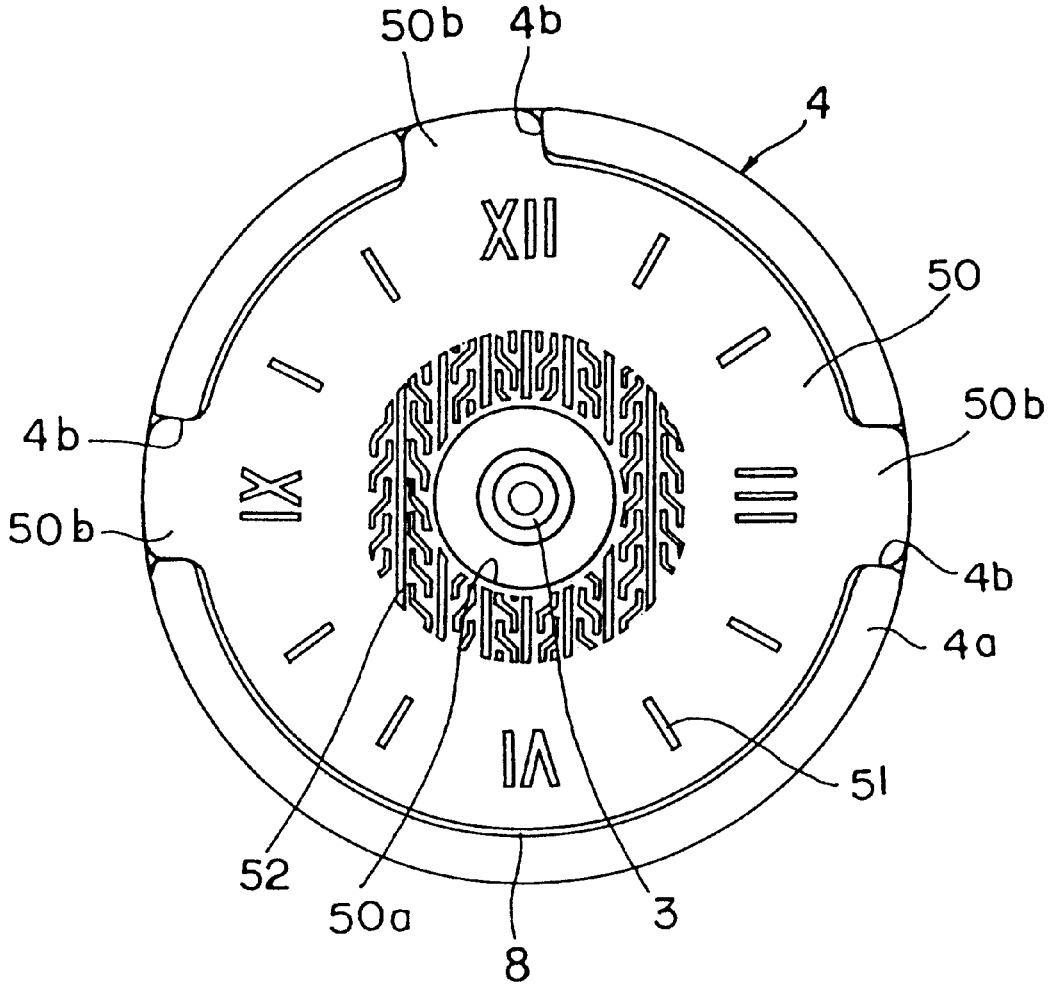
FIG. 3 is a top plan view showing a modification of the embodiment of the present invention shown in FIG. 1, in which the casing of a watch is omitted.

Incidentally, in the metallic plate 50 shown in FIG. 1, only a scale and numerals are formed by the through-hole 51. However, there are no limitations to the indications and decorations formed in the metallic plate 50 and a scale, numerals, patterns, and the like provided in the metallic plate 50 may be optional. Specifically, for example, the hole 50*a* in the center of the metallic plate 50 is formed into a shape constituting a desired pattern; and a light transmitting hole 52 with a pattern is further formed around the center (outer peripheral portion of the hole 50*a*) of the metallic plate 50 as shown in FIG. 3.

The light transmitting hole 50*a*, the through-hole 51, and the like are formed in the metallic plate 50 in this manner, whereby the light from an EL device can be transmitted to the surface of the metallic plate 50 through the hole 50*a* and the through-hole 51 when the cell 2, on which the metallic plate is mounted, is the EL device; and solar light can be transmitted to a solar battery via the hole 50*a* and the through-hole 51 when the cell 2 is the solar battery.

Therefore, the areas of the through-hole 51 and the hole 50*a* can be increased in the case of increasing the light transmitting ratio.

Because the hole 50*a*, the through-hole 51, and the like vary in shape and the color of the metallic plate 50 itself is optional, the design variations of the display can be greater without the cell 2 being exposed externally.

The watch having the above structure is fabricated as follows:

First, the metallic plate 50 is mounted on the surface of the cell 2 on the movement 1.

Then, the convex portions 50*b* projecting from the outer periphery of the metallic plate 50 are aligned and engaged with the concave portions 4*b* of the casing frame 4. For this alignment, the positions of the convex portions 50*b* may conform with the positions of the concave portions 4*b* and hence the alignment can be carried out exactly by visual observation of an operator in an extremely simple manner.

Next, the metallic plate is pressed downward to secure it firmly to the surface of the cell 2. At this time, if the dimensions of the metallic plate 50 and casing frame 4 are designed so that a clearance 8 in a radial direction is allowed between the outer periphery of the portion of the metallic plate 50 excepting the convex portions 50*b* and the inner periphery of the portion of the casing frame 4, the securing operation can easily be carried out even if there are some dimensional errors between the two.

The light transmitting type metallic plate 50 is simply secured to the casing frame 4 by engaging the convex portions 50*b* with the concave portions 4*b* in this manner. Also, the concave portions 4*b* and convex portions 50*b* are respectively formed at three positions, hence the engaged metallic plate 50 neither shifts laterally nor rotates even if force is applied in a horizontal direction.

Also, when the metallic plate 50 is detached from the watch, the outer periphery of any of the convex portions 50*b* of the metallic plate 50 is pushed upward using a pincette or the like to disengage the convex portions 50*b* from the concave portions 4*b*, whereby the metallic plate 50 can be detached from the casing frame 4.

In the above-mentioned embodiment, though the number of the concave portions 4*b* of the casing frame 4 and the number of the convex portions 50*b* of the metallic plate 50 are respectively three, the numbers of the convex portion and the concave portion may be two or four or more respectively.

Also, in this case, at least one concave portion and one convex portion among these concave portions and convex portions are slightly shifted so as to be positioned asymmetrically (for example, a position at 12 o'clock to a position at 7 o'clock in the case of using two each), whereby the light transmittable type metallic plate 50 can coincide with the casing frame 4 in these directions and can be aligned with the casing frame 4 with ease.

Second Embodiment

A second embodiment of a watch containing a light transmitting metallic dial in the present invention will be explained with reference to FIGS. 4 and 5.

Figure 4:
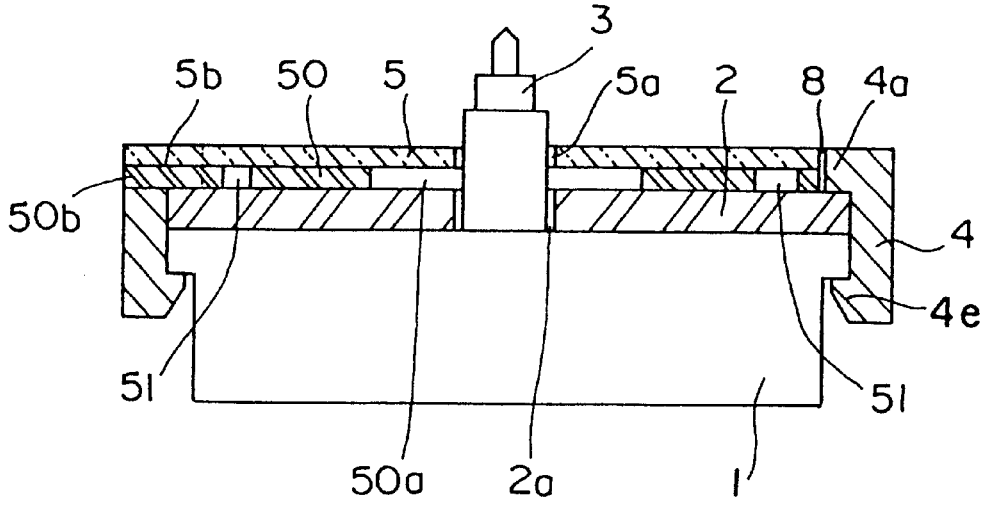
FIG. 4 is a schematically sectional view of an example in a second embodiment of the present invention, in which the casing of a watch is omitted.
Figure 5:
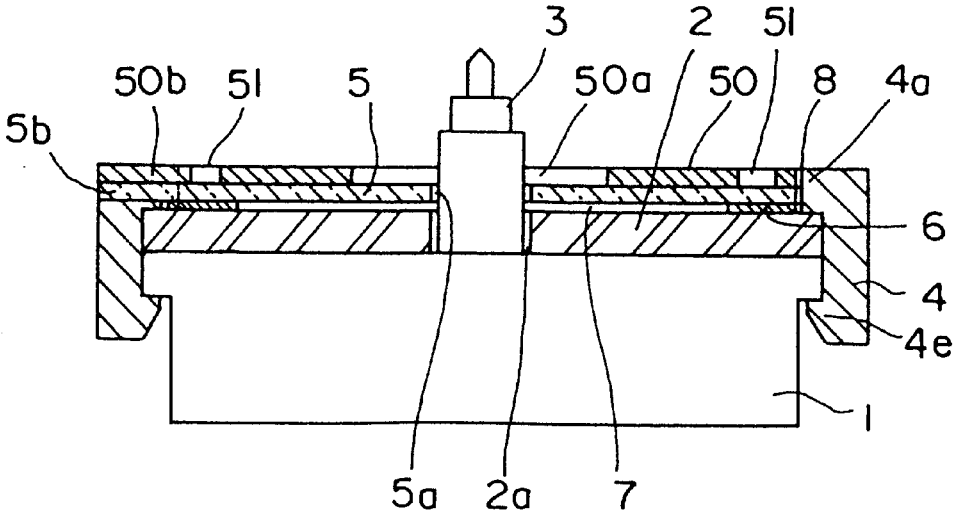
FIG. 5 is a schematically sectional view of another example in the second embodiment of the present invention, in which the casing of a watch is omitted.

FIGS. 4 and 5 are schematically sectional views corresponding to a second embodiment of the present invention, in which the casing of a watch is omitted.

The watch of the second embodiment in the present invention shown in FIGS. 4 and 5 is a modification of the above-mentioned first embodiment. In this modification, a transparent plate 5 composed of a light transmitting material is laminated on a light transmitting metallic dial 50.

Here, in this embodiment, the transparent plate 5 composed of a light transmitting material may be laminated on the metallic plate 50 as shown in FIG. 4 or the metallic plate 50 may be laminated on the transparent plate 5 as shown in FIG. 5.

In this embodiment, the transparent plate 5 composed of a light transmitting material is produced by forming a thin plate using a transparent or translucent color resin such as an acryl resin, polycarbonate resin, or the like; translucent ceramics, or precious stone such as a sapphire, ruby, or the like, by means of mechanical processing, molding, or the like.

Specifically, in the light transmitting transparent plate (hereinafter, simply called "transparent plate" including a translucent plate) 5, a hole 5*a* for inserting a hand shaft 3 is formed in the center of the transparent plate in the same manner as in the metallic plate 50 and convex portions 5*b* projecting externally from the periphery of the transparent plate 5 are formed as aligning portions at three positions of the periphery corresponding to concave portions 4*b* formed at a flange portion 4*a* of a casing frame 4.

The convex portions 5*b* engage with the concave portions 4*b*, whereby the metallic plate 50 and the transparent plate 5 are integrated with the cell 2.

This transparent plate 5, other than the above-described plate formed by mechanical processing, molding, or the like, can be prepared by laminating the above-described material on one or both of the surfaces of the metallic plate 50 by means of printing, painting, or the like, which enables mass-production of a display provided with the transparent plate 5. Desired coloring of the transparent plate 5 can be simply attained.

The light transmittance of the transparent plate 5 is preferably from 10% to below 100% so that the light from an EL device can be sufficiently transmitted to the surface of the metallic plate 50 when the cell 2 is the EL device and solar light can be sufficiently transmitted to a solar battery under the metallic plate 50 when the cell 2 is the solar battery.

There are no limitations to the color of the transparent plate 5. If it can transmit the light from the EL device, the color may be either transparent or colored. The transparent plate 5 may either consist entirely of one color or may have a plurality of differently colored regions.

The surface of the transparent plate 5 may be decorated with a scale, commercial name, numerals, patterns, and the like by printing, painting, or the like. If the transparent 5 itself has an uneven surface, the decorated portion can be stereo-graphically indicated.

The decoration, color, and the like for the transparent plate 5 are optionally selected and matched with the metallic plate 50, which enables provision of various displays for a watch.

As for the transparent plate 5 in this embodiment, there is the case of laminating the transparent plate 5 on the metallic plate 50 and the case of laminating the metallic plate 50 on the transparent plate 5. In the case of laminating the metallic plate 50 on the transparent plate 5 in this embodiment, a ring spacer 6 is interposed between the cell 2 and the transparent plate 5 along the outer periphery of the transparent 5 to form a clearance 7 and thereby to prevent the occurrence of light interference fringes such as a Newton's ring or the like between the two.

These measures serve to prevent the occurrence of light interference fringes due to the clearance 7 even if the transparent plate 5 composed of a light transmitting material is laminated on the metallic plate 50 thereby improving the light collecting efficiency, hence the display is clear and the appearance of the display can be improved.

As means of providing the clearance 7 between the cell 2 and the transparent plate 5, the clearance 7 can be formed by design only to elevate part of the bottom of the concave portions 4*b* of the casing frame 4. Other than this, various structures can be adopted to form a clearance between the cell 2 and the transparent plate 5 and thereby to prevent the occurrence of light interference fringes.

Figure 6:
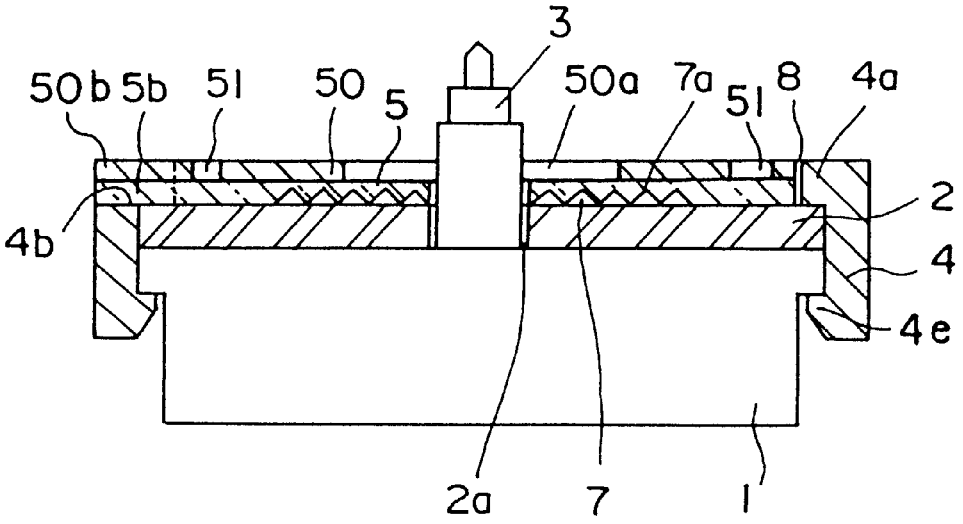
FIG. 6 is a schematically sectional view of an example in the case of providing a clearance between a cell and a transparent plate in the second embodiment of the present invention, in which the casing of a watch is omitted.

As shown in FIG. 6, for example, an irregularity 7*a* is formed at the contact surface between the transparent plate 5 and the cell 2 so that the clearance 7 can be formed between the cell 2 and the transparent plate 5. In this case, since the irregularity 7*a* constitutes patterns, the design variations of the display increase. Also, because the occurrence of light interference fringes such as a Newton's ring or the like can be prevented due to the clearance 7 formed between the cell 2 and the transparent plate 5, a reduction in product value caused by the light interference fringes can be avoided.

This irregularity 7*a* may be formed not only on the back face of the transparent plate 5, but also on the face which contacts the transparent plate opposing the surface of the cell 2 or on both the contact face of the cell 2 and that of the transparent plate.

Also, the shape, size, and density of the irregularity 7*a* are optional. The irregularity 7*a* may be a satin finish and may be formed either on part or all of the back face of the transparent plate 5 or on part or all of the surface of the cell.

Also, the shape of the irregularity 7*a* may be optional as above-mentioned and the shape in section of the irregularity may be triangle as shown in FIG. 6 or may be a shape such as rectangle, circle, or the like other than triangle. In addition, the irregularity 7*a* has either a uniform shape as shown in FIG. 6 or a mixed shape formed of plural shapes.

Further, the irregularity can be utilized to form characters and symbols, which indicate time, or decorative patterns.

Figure 7:
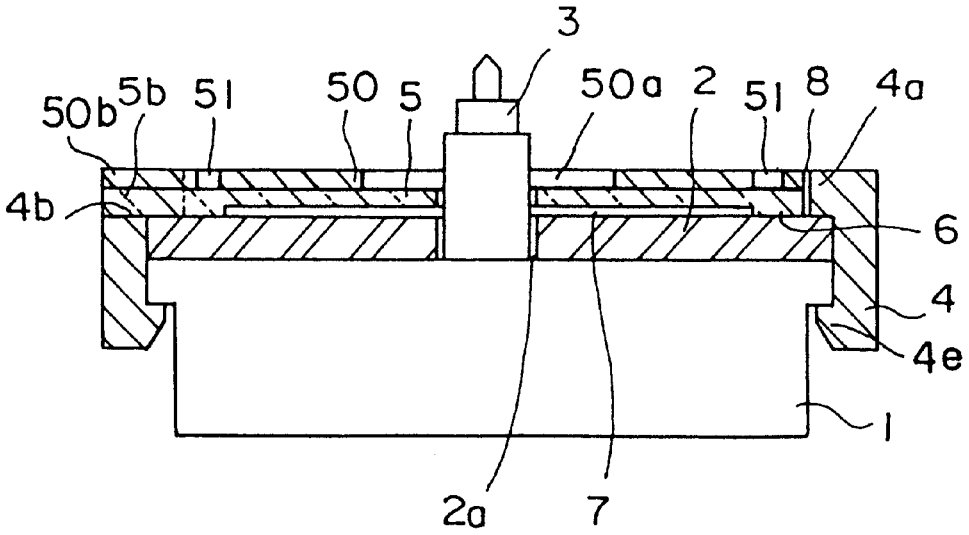
FIG. 7 is a schematically sectional view of another example in the case of providing a clearance between a cell and a transparent plate in the second embodiment of the present invention, in which the casing of a watch is omitted.

On the other hand, as shown in FIG. 7, a spacer 6 may be formed on part or all of the outer periphery of the back face of the transparent plate 5 in a manner so that the spacer 6 is integrated with the transparent plate 5, to form the clearance 7.

In such a structure, it is not necessary to separately produce a spacer and an operation for interposing a spacer between the cell 2 and the transparent plate 5 can be omitted.

Figure 8:
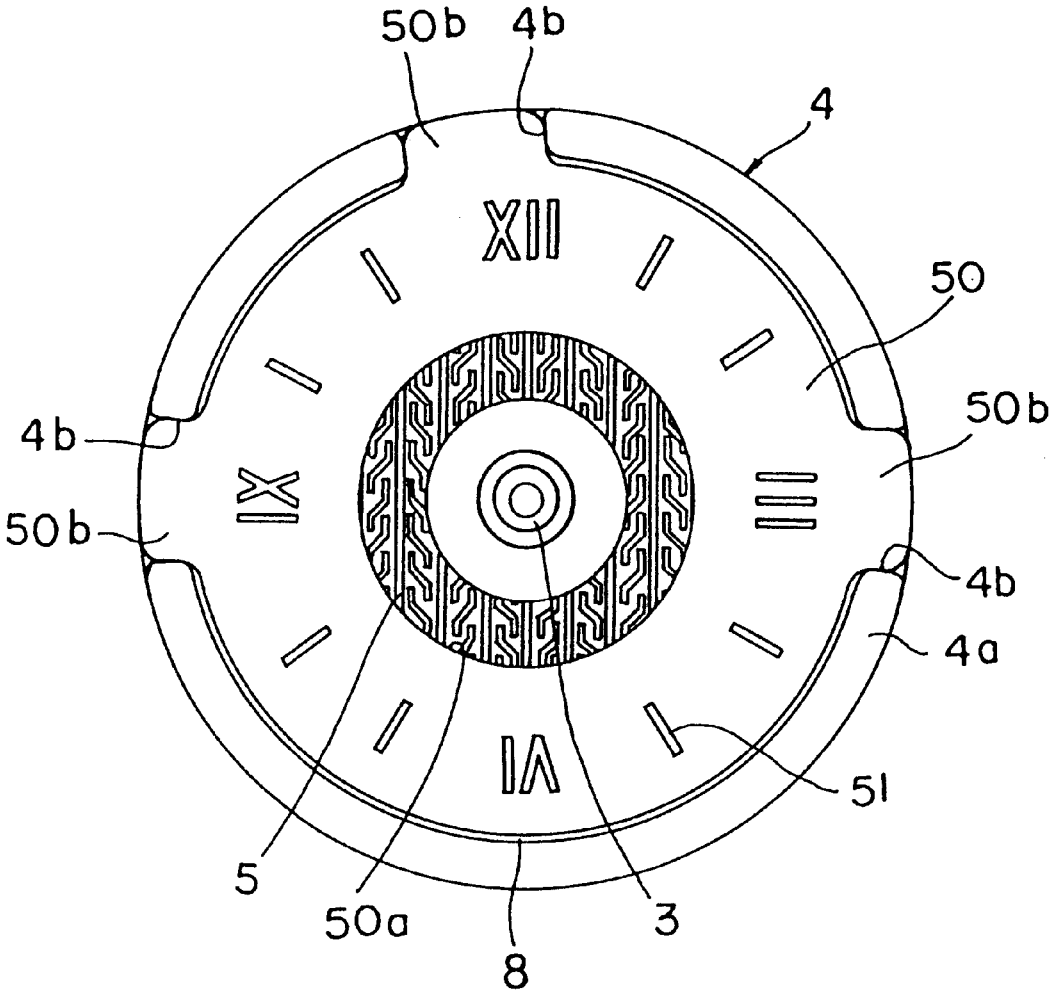
FIG. 8 is a top plan view showing a modification of the first embodiment of the present invention shown in FIG. 1, in which the casing of a watch is omitted.

Also, in the transparent plate 5 of each watch in the present invention, a scale, numerals, patterns, or the like are optionally formed. For example, if the transparent plate 5 provided with patterns is arranged under the metallic plate 50, this allows the patterns to be viewed from the hole 50*a* formed in the center of the metallic plate 50 as shown in FIG. 8.

As mentioned above, when mounting the metallic plate 50 shown in FIG. 4 on the cell 2, there is no need to provide a clearance between the cell 2 and the metallic plate 50 because the metallic plate 50 functions as a spacer so that it is unnecessary to interpose a spacer between the two.

In this embodiment, as shown in FIGS. 5 to 7, the transparent plate 5 of one layer is laminated on the surface or the back face of the metallic plate 50 of one layer. Other than this embodiment, such an embodiment as described in the following can be adopted.

Specifically, a metallic plate produced by laminating at least any one of each of the other metallic plates and transparent plates on the metallic plate 50 of one layer may be used. This metallic plate has effect the same as, or more excellent than the metallic plate of one layer.

Various embodiments relating to the laminating conditions between the metallic plate 50 and the transparent plate 5 are now explained with reference to FIGS. 9 to 12.

FIGS. 9 to 12 are schematically explanatory views showing the laminating condition of a metallic plate 50 and a transparent plate 5.

First, as shown in FIG. 9(*a*), the metallic plate 50 and the transparent plate 5 may be laminated using one layer each as mentioned above. Other than this, as shown in FIG. 9(*b*), only a metallic plate need to be plurally laminated and, as shown in FIG. 9(*c*), one or more transparent plates 5 may be laminated on the back face (or on the surface or in the middle of the plural metallic plates 50 of the plurally laminated metallic plate 50.

In such a structure, in which the transparent plate 5 and the metallic plate 50 are plurally laminated, light transmitting holes formed in the metallic plate 50 can contribute to profoundly three-dimensional expression. Also, a pattern, color, and the feel of a material are allowed to differ at every hole in the metallic plate 50 and thereby increase the variations of the display.

Also, as shown in FIGS. 10(*a*) and 10(*b*), the centers of the through-holes 51 and the like of metallic plates 50 may be placed in different positions in the case where the metallic plate 50 is plurally laminated. For this structure, unevenly and sharply three-dimensional expression for the through-hole 51 or the like can be attained.

Also, in the case of laminating a plurality of metallic plates 50, for example, using a rotating brush, a pattern of longitudinal extra fine hair lines running from 12 o'clock to 6 o'clock is formed on the surface of the upper metallic plate 50 and a pattern of lateral hair lines running from 9o'clock to 3o'clock is formed on the surface of the lower metallic plate 50 (or the transparent plate 5). The pattern of lower lateral hair lines appears from the through-hole 51, constituting characters on the upper metallic plate 50, whereby pattern differences of crossed and three-dimensional hairlines can be readily prepared by only laminating two metallic plates 50.

Figure 12:
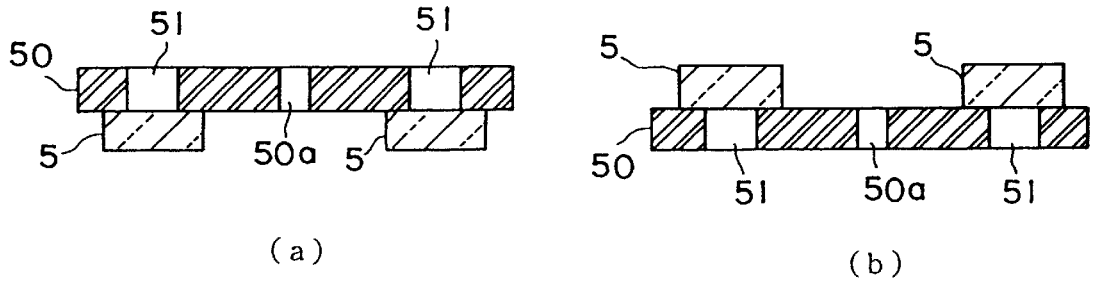

Further, as shown in the above-described FIGS. 9 or 11, the transparent plate 5 is laminated on the entire upper or lower surface of the metallic plate 50 in the above embodiments. However, the transparent plate 5 may be partially laminated on part of the upper or lower surface of the metallic plate 50 as shown in FIGS. 12(*a*) and 12(*b*).

The through-hole of the metallic plate 50 can be decorated using a necessary minimum number of transparent plates 5, hence the material costs for a light transmitting material forming the transparent plate 5 can be reduced.

Third Embodiment

A third embodiment of a watch containing a light transmitting metallic dial in the present invention will be explained with reference to FIGS. 13 and 14.

Figure 13:
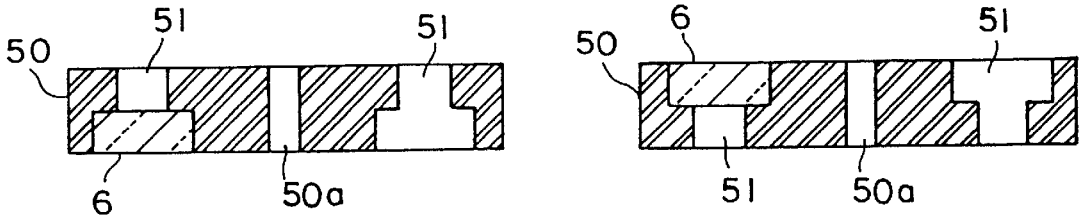
Figure 14:
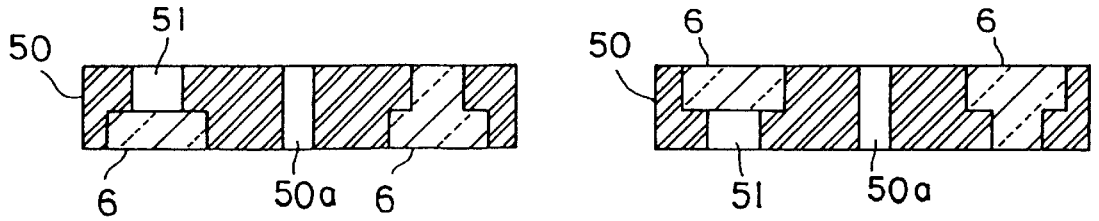

FIGS. 13 and 14 are schematic views showing the laminating relation between a metallic plate 50 and a transparent plate 5.

As shown in these figures, in this embodiment, a light transmitting material 6 composed of a colored resin, ceramic, precious stone, or the like is disposed so that it is fitted in a through-hole 51 formed in the metallic plate 50.

In the above-described second embodiment, a light transmitting material is formed as the thin plate-type transparent plate 5, which is laminated on the surface or back face of the metallic plate 50, and the transparent plate 5 is disposed in the condition where the through-hole 51 and the like of the metallic plate 50 is blocked by the transparent plate 5. However, in this embodiment, a light transmitting material 6 is directly fitted in the through-hole 51 and the like of the metallic plate 50.

For example, as shown in FIGS. 13(*a*) and 13(*b*), the light transmitting material 6 is disposed so that it is fitted in at least one of the through-holes 51 formed plurally in the metallic plate 50.

Also, the light transmitting material 6 which is fitted in the through-hole 51 and the like of the metallic plate 50 may be disposed so that it extends either the entire length of the through-hole 51 and the like as shown in FIGS. 14(*a*) and 14(*b*) or over part of the through-hole 51 and the like.

Here, the portion into which the light transmitting material 6 is inserted, in the through-hole 51 of the metallic plate 50 shown in FIGS. 13 and 14, is larger in diameter than the remaining portion. Therefore the installation of the light transmitting material 6 is facilitated. Incidentally, the through-hole 51 and the like maybe formed so that the diameters of all these portions including the portion into which the light transmitting material is inserted and the remaining portion are the same.

According to this embodiment, the light transmitting materials 6 which are provided with patterns and the like and which are different in color and material characteristics can be fitted, for example, into part or all of a hole 50*a* formed in the center of the metallic plate 50 and an other through-hole 51. The through-hole of the metallic plate 50 can be decorated using a necessary minimum number of light transmitting materials 6.

The material costs for the light transmitting material 6 can be reduced. Also, the light transmitting materials fitted into each hole can differ, whereby patterns and colors are allowed to differ in each of the holes of the metallic plate 5, hence the variations of the display can be increased.

For example, if the light transmitting material 6 composed of a precious stone such as a sapphire, ruby, or the like, is fitted into the through-hole 51 and the like of the metallic plate 50, the watch acquires a high grade feeling. Also, a dial including characters of different colors can be easily prepared by fitting light transmitting material with different colors into each metallic plate or each through-hole 51.

In this embodiment, also, other structures, for example, the shape and securing structure of the metallic plate 50 and the like are similar to those in the previous embodiments and a scale, numerals, patterns, and the like of the metallic plate 50 are optional.

In addition, the light transmitting material 6 may be simply installed on the metallic plate 50 in a mass production enabling manner by a method such as molding, printing, coating, or the like (for example, pseudo cloisonne in the case of using a light transmitting material composed of a precious stone).

Fourth Embodiment

A fourth embodiment of a watch containing a light transmitting metallic dial in the present invention will be explained with reference to FIGS. 15 and 17.

FIGS. 15 to 17 are a top plan view, an enlarged top plan view showing a major part, and an enlarged side view showing a major part corresponding to a fourth embodiment of the present invention, in which the casing of a watch is omitted.

In the watch shown in these figures corresponding to the fourth embodiment of the present invention, a notch 50*c* which is externally opened and penetrates from the surface to the back face of a convex portion 50*b* of a casing frame 4 is provided in almost the center of the convex portion 50*b* which is an aligning portion for a metallic plate 50. Also, a projection 4*c* which is engaged with the notch 50*c* of the metallic plate 50 projects from almost the center of the convex portion 4*b* of the casing frame 4.

In this case, the notch 50*c* is deeply notched in the convex portion 50*b* to form a clearance relative to the projection 4*c*. Specifically, a clearance 8*a* similar to the clearance 8 between the outer periphery of the metallic plate 50 and the inner periphery of the casing frame 4 is formed to facilitate the securing operation for the metallic plate 50 in the same manner as in the first and second embodiments.

Also, in this embodiment, the notch 50*c* of the convex portion 50*b* is engaged with the projection 4*c* of the concave portion 4*b* whereby the metallic plate 50 is firmly secured to the projection 4*c* of the casing frame 4. Therefore, as shown in FIGS. 16 and 17, the width of the convex portion 50*b* may be smaller than the width of the concave portion 4*b* to form the clearance 8*b*, hence a failure in engagement never occurs even if there are some dimensional errors between the convex portion 50*b* and the concave portion 4*b*. Because of this and also because of the formation of the clearance 8*a*, the securing operation is further facilitated.

This fourth embodiment may be applied to the structures in the second and third embodiments in which the transparent plate 5 and the metallic plate 50 are laminated.

In this case, the transparent plate 5 is provided with a convex portion in which a notch similar to that formed in the above-mentioned metallic plate 50 is formed.

Also, though, in this embodiment, as shown in FIG. 15, the notch 50*c* is formed in every convex portion 50*b* of the metallic plate 50 and the projection 4*c* is formed in every concave portion 4*b* of the casing frame 4, the notch and projection may be formed in part of the convex portions 50*b* and the concave portions 4*b* respectively. The number and position of the notches and projections may be optionally selected.

Fifth Embodiment

Next, a fifth embodiment of the present invention will be explained with reference to FIGS. 18 and 20.

FIGS. 18 to 20 are a top plan view, an enlarged top plan view showing a major part, and an enlarged side view showing a major part corresponding to a fifth embodiment of the present invention, in which the casing of a watch is omitted.

The watch of the fifth embodiment has a structure in which a metallic plate 50 is laminated on a transparent plate 5 in the same manner as shown in FIG. 5 corresponding to the second embodiment, and an aligning portion of the metallic plate 50 is further improved.

Specifically, a convex portion 5*b* of a transparent plate 5 is provided with a notch 5*c* in almost the center thereof to engage with a projection 4*c* of a concave portion 4*b* of a casing frame in the same manner as the aligning portion of the metallic plate 50 in the fourth embodiment.

On the other hand, the aligning portion of the metallic plate 50 has a structure in which a convex portion 50*b* is formed of two projecting strips 50*d* and a notch is formed in each opposing side of root portions of the projecting strips 50*d* so as to bend inward owing to metal elasticity. Also, a small through-hole 50*e* is formed in each of the tip portions of the projecting strips 50*d*.

In this case, in securing the transparent plate 5 and the metallic plate 50, first, each convex portion 5*b* of the transparent plate 5 is engaged with each corresponding concave portion 4*b* of the casing frame 4 while each of the notches 5*c* of the convex portion 5*b* is engaged with the projection 4*c* of each of the concave portions 4*b* to secure the transparent plate 5 to the casing frame 4. Next, the two projecting strips 50*d* of each of the convex portion 50*b* of the metallic plate 50 are pressed into each of the concave portions 4*b* of the casing frame 4 while the two projecting strips 50*d* are bent inward to secure the metallic plate 50 to the casing frame 4 in the condition where the metallic plate 50 is laminated on the surface of the transparent plate 5. By this measure, a display including the transparent plate 5 and the metallic plate 50 is secured to and supported by the casing frame 4 in an integrated manner.

Specifically, as shown in FIGS. 18 and 19, the outsides of the projecting strips 50*d* press outward against the insides of the concave portion 4*b* respectively, whereby the projecting strip 50*d* is firmly secured to the concave portion 4*b*.

The metallic plate 50 is detached by pressing the projecting strips 50*d* upward using a pincette or the like to disengage the projecting strips 50*d* from the concave portion 4*b* which presses the projecting strips 50*d*. Also, the metallic plate 50 is more easily detached by inserting both ends of a pincette or the like into holes 50*e* of the two projecting strips 50*d* to clip the holes 50*e* and by bending the concave portion 4*b* inward to disengage the projecting strips 50*d*.

Sixth Embodiment

Next, a sixth embodiment of the present invention is explained with reference to FIG. 21.

FIG. 21 is a top plan view corresponding to the sixth embodiment of the present invention, in which the casing of a watch is omitted.

The watch of the sixth embodiment is a further improvement of the above-mentioned fifth embodiment. Among the convex portions 50*b* of a metallic plate 50, two facing convex portions 50*b* have a configuration with two projecting strips 50*d* in the same manner as in the fifth embodiment and each of the remaining convex portions 50*b* has the same configuration as in the fifth embodiment in which a notch 50*c* is formed in almost the center of the convex portion 50*b*.

In this sixth embodiment, the two projecting-type convex portions clearly differ from the remaining one notch-type convex portion. If a fabrication worker remembers which concave portion of the casing frame 4 corresponds to the notch-type convex portion, he will never make a mistake in determining the correspondence between each of the convex portions 50*b* and convex portions 4*b* and hence the metallic plate 50 can be smoothly engaged with and secured to the casing frame 4.

In this case, it is desirable that the two projecting-type convex portions differ in shape from the remaining one notch-type convex portion so that the difference in shape can be clearly observed. In this structure of the sixth embodiment, aligning, engaging, and securing operations for the metallic plate 50 can be performed more accurately and promptly.

The number and position of the projecting-type convex portions and notch-type convex portions can be optionally altered depending on the number of aligning portions, that is, convex portions.

Next, embodiments (seventh to ninth embodiments) of a light transmitting dial securing structure, which differ from the embodiments of the above-described light transmitting type dial fixing structure will be explained with reference to FIGS. 22 to 26.

Seventh Embodiment

FIG. 22 is a schematically sectional view showing the seventh embodiment of the present invention, in which the casing of a watch is omitted.

In this embodiment, a cell 2 such as an EL device, solar battery, or the like is mounted on the surface of a movement 1 and a metallic plate 50 provided with through-holes 51, 50*a* constituting a scale, numerals, patterns, and the like is provided. A plurality of fitting holes 1*c* is formed at an optional position on the outer periphery of the movement 1. Also, through-holes 2*b* are formed at the positions corresponding to the fitting holes 1*c*.

Further, on the back face of the metallic plate 50, a projection 50*f* is formed at the position corresponding to the fitting hole 1*c* and through-hole 2*b*. This projection 50*f* penetrates the through-hole 2 to engage with the fitting hole 1*c* of the movement 1, whereby the cell 2 and the metallic plate 50 are firmly secured to the movement 1.

The outer periphery of the metallic plate 50 is clipped by a watch casing though not shown, thereby preventing the metallic plate 50 from falling out of the fitting 1*c*.

Even in such a structure of this embodiment, the cell 2 and the metallic plate 50 are secured easily and firmly.

Incidentally, the number of the projections 50*f* may be optional and, for example, when the number is three, two are disposed facing each other at an angle of 180 degrees, and the remaining one is disposed at a position slightly offset from the center of the opposed projections 50*f*.

Also, among the projections 50*f*, a part of these changes in diameter and the like to facilitate distinguishing the projections 50*f* and thereby improving the workability in the fabricating steps.

Eighth Embodiment

FIG. 23 is a schematically sectional view showing the eighth embodiment of the present invention, in which the casing of a watch is omitted. In this embodiment, a light transmitting metallic dial is produced by laminating a metallic plate 50 on the surface of a transparent plate 5. A movement 1, cell 2, and metallic plate 50 are the same as those in the seventh embodiment shown in FIG. 22.

On the other hand, a through-hole 5*g* is formed on the transparent plate 5 at the position corresponding to the projection 50*f* of the metallic plate 50. The projection 50*f* of the metallic plate 50 penetrates the through-hole 5*g* of the transparent plate 5 and a though-hole 2 of the cell 2 and is engaged with a fitting hole 1*c* of the movement 1, whereby the cell 2, transparent plate 5, and metallic plate 50 are firmly secured to the movement 1.

In this case, a spacer 6 is integrated with the back face at the periphery of the through-hole 5*g* to form a clearance 7 relative to the cell 2, thereby preventing the occurrence of a Newton's ring and the like.

This spacer 6 may be designed in various configurations in the same manner as in the second embodiment and may be formed independently of the transparent plate 5. Also, the clearance 7 between the cell 2 and the transparent plate 5 may be formed by the structure in which unevenness is formed on the transparent plate 5 and/or cell 2.

Though not shown, the display may have a structure in which the transparent plate 5 is laminated on the surface of the metallic plate 50. In this case, a projection is formed on the back face of the transparent plate 5 and a through-hole is formed in the metallic plate 50 to firmly secure the cell 2, transparent plate 5, and metallic plate 50 to the movement 1.

Contrary to the above seventh embodiment and this embodiment, the projection and the securing hole may be inversely formed. Specifically, the projection is formed on the surface of the movement 1 and the fixing hole may be formed on the corresponding portion of the light transmitting metallic dial composed of the transparent plate or the metallic plate.

Ninth Embodiment

FIGS. 24 to 26 are a partial top plan view corresponding to a ninth embodiment of the present invention, a sectional view along the line 25—25 in FIG. 24, and a sectional view along the line 26—26 in FIG. 24 respectively. In this embodiment, a projection 1*a* is formed on and integrated with the surface of a movement 1 to form a spacer, a cell 2 is secured to and supported by a watch casing 30 via a cell support frame 41, and a metallic plate 50 is directly secured to and supported by the armor 30.

A transparent plate is laminated on the back face of the metallic plate 50 in the same manner as in the second embodiment shown in FIG. 5.

Specifically, the cell 2, which has a somewhat smaller diameter than the movement 1 and in which the portions thereof corresponding to a convex portion 50*b* of the metallic plate 50 and a convex portion 5*b* of the transparent plate 5 are cut, is mounted on the surface of the movement 1. The cell 2 is mounted on a receiving portion 1*b* (not shown in FIG. 24) formed on the movement 1. Also, the vicinity of the periphery of the cell 2 is secured by the casing 30 via a cell support frame 41 (see FIGS. 25 and 26).

In the cell support frame 41, a concave portion 41*b* is formed at the position corresponding to the convex portion 50*b* of the metallic plate 50 and the convex portion 5*b* of the transparent plate 5.

Also, the projection la higher than the surface of the cell 2 is formed on the surface of the movement 1 at the position corresponding to the concave portion 41*b*.

In such a structure, the convex portion 5*b* of the transparent plate 5 laminated on the back face of the metallic plate 50 is engaged with the concave portion 41*b* and positioned on the upper face of the projection 1*a* to form a clearance 7 between the cell 2.

When the outer peripheries of the metallic plate 50 and the transparent plate 5 are clipped by the casing 30 in this condition, the metallic plate 50 and the transparent plate 5 is integrated with the cell 2 and supported and secured by the casing 30 (see FIG. 26).

As shown in FIGS. 24 to 26, since the width of the casing 30 in a radial direction is increased, the convex portion 50*b* of the metallic plate 50, convex portion 5*b* of the transparent plate 5, and concave portion 41*b* of the cell support frame 41 are covered by the casing 30 so that these cannot be viewed from the surface side, hence design characteristics can be improved.

In this embodiment, though the transparent plate 5 is laminated on the back face of the metallic plate 50, the metallic plate 50 may be laminated on the surface of the cell 2 and the transparent plate 5 may be laminated on the surface of the metallic plate 50 in the same manner as in the case shown in the above-described FIG. 4. In this case, the metallic plate acts as a spacer so that a Newton's ring and the like never occurs. Therefore, the projection 1*a* of the movement 1 can be omitted.

In this embodiment and the above-mentioned fifth, sixth, and eighth embodiments, the transparent plate 5 is laminated on the metallic plate 50 to constitute the light transmitting metallic dial. Accordingly, these embodiments may be also applied similar to the case where a plurality of metallic plate 50 is laminated.

As is clear from the above explanations, the watch containing the light transmitting metallic plate according to the present invention is efficiently utilized for various watches containing an absorbing material such as a solar battery and a light emitting material including an EL device, liquid crystal, various power supplies, light diffraction plate, and the like.

What is claimed is:

1. A watch containing a light transmitting metallic dial formed by laminating a cell comprising an emitting member or an absorbing member on a movement and securing the cell by a casing frame, wherein a metallic dial is disposed above the cell comprising an emitting member or an absorbing member, and a plurality of light transmitting through-holes are formed by drilling in the metallic dial.

2. The watch containing a light transmitting metallic dial according to claim 1, wherein the through-holes formed by drilling in the metallic dial form a scale, numerals, patterns.

3. The watch containing a light transmitting metallic dial according to claim 2, wherein at least one of a metallic dial and/or a light transmitting material in which a plurality of light transmitting through-holes are formed is further laminated on the metallic dial.

4. The watch containing a light transmitting metallic dial according to claim 3, wherein, in the case where the metallic dial is plurally laminated, the through-hole of each metallic dial is formed by drilling so as to allow the centers of the through-holes to be placed at different positions.

5. The watch containing a light transmitting metallic dial according to claim 3, wherein the light transmitting material is laminated on the whole of the surface and/or back face of the metallic dial.

6. The watch containing a light transmitting metallic dial according to claim 3, wherein the light transmitting material is laminated on part of the surface and/or back face of the metallic dial.

7. The watch containing a light transmitting metallic dial according to claim 2, wherein a light transmitting material is disposed in at least one of a plurality of through-holes formed by drilling in the metallic dial.

8. The watch containing a light transmitting metallic dial according to claim 7, wherein the light transmitting material is formed so that it extends either the entire length or over part of the through-hole.

9. The watch containing a light transmitting metallic dial according to claim 3, wherein the light transmitting material is formed on the cell by molding, printing, or coating.

10. The watch containing a light transmitting metallic dial according to claim 3, wherein the light transmittance of the light transmitting material is in a range of from 10% to 100%.

11. The watch containing a light transmitting metallic dial according to claim 3, wherein a clearance for preventing the occurrence of light interference fringes is formed between the light transmitting material and the cell.

12. The watch containing a light transmitting metallic dial according to claim 2, wherein a material used for the metallic dial is any of brass, copper, nickel silver, stainless steel, titanium, titanium alloy, aluminum, aluminum alloy, or nickel.

13. The watch containing a light transmitting metallic dial according to claim 2, wherein an aligning portion is formed at the outer periphery of the metallic dial and an aligning portion is formed on the casing frame whereby both aligning portions are engaged to secure the metallic dial and the cell to the casing frame.

14. The watch containing a light transmitting metallic dial according to claim 13, wherein a clearance is formed between the outer periphery of the metallic dial excepting the aligning portion, and the inner periphery of the casing frame excepting the aligning portion.

15. The watch containing a light transmitting metallic dial according to claim 13, wherein the aligning portion of the metallic dial is a-convex portion projecting from the outer periphery of the metallic dial and the aligning portion of the casing frame is a concave portion formed in the casing frame.

16. The watch containing a light transmitting metallic dial according to claim 15, wherein a notch is formed in almost the center of the convex portion projecting from the metallic dial and a projection is formed on the concave portion formed in the casing frame at the position corresponding to the notch of the convex portion.

17. The watch containing a light transmitting metallic dial according to claim 2, wherein an aligning portion projecting from the back face of the metallic dial is formed, an aligning hole is formed in the movement at the position corresponding to the projecting aligning portion, and the projecting aligning portion is allowed to penetrate the cell and engage with the aligning hole, to secure the metallic dial and the cell to the movement.

18. The watch containing a light transmitting metallic dial according to claim 3, wherein, in the case where a metallic dial and/or the light transmitting material are plurally laminated on the metallic dial, an aligning portion projecting from the back face of the top metallic dial is formed, a through hole is formed by drilling in each of a metallic dial laminated beneath the top metallic dial, a light transmitting material, and the cell, an alignment hole is formed in the position corresponding to the aligning portion of the movement, the projecting aligning portion is allowed to penetrate each through hole in the metallic dial, light transmitting material, and cell to engage with the aligning hole, to secure the metallic dial which is plurally laminated, the light transmitting material, and the cell to the movement.

* * * * *